US011344765B2

(12) United States Patent
Smith

(10) Patent No.: US 11,344,765 B2
(45) Date of Patent: May 31, 2022

(54) EXERCISE MACHINE WITH BI-DIRECTIONAL ANGULAR RESISTANCE

(71) Applicant: TRIPLE C MOTION LLC, Canyon Lake, TX (US)

(72) Inventor: Joseph Smith, Canyon Lake, TX (US)

(73) Assignee: TRIPLE C MOTION LLC, Canyon Lake, TX (US)

( * ) Notice: Subject to any disclaimer, the term of this patent is extended or adjusted under 35 U.S.C. 154(b) by 0 days.

(21) Appl. No.: 17/147,733

(22) Filed: Jan. 13, 2021

(65) Prior Publication Data

US 2021/0213322 A1 Jul. 15, 2021

Related U.S. Application Data

(60) Provisional application No. 62/960,813, filed on Jan. 14, 2020.

(51) Int. Cl.
*A63B 21/22* (2006.01)
*A63B 21/00* (2006.01)
*A63B 21/015* (2006.01)

(52) U.S. Cl.
CPC ..... *A63B 21/227* (2013.01); *A63B 21/00192* (2013.01); *A63B 21/015* (2013.01);
(Continued)

(58) Field of Classification Search
CPC ..... A63B 21/00; A63B 21/00043; A63B 21/00047; A63B 21/00058;
(Continued)

(56) References Cited

U.S. PATENT DOCUMENTS 4,390,180 A * 6/1983 Simjian ..... A63B 22/14 482/146
5,545,111 A * 8/1996 Wang ..... A63B 22/0064 482/53

(Continued)

OTHER PUBLICATIONS

International Search Report and Written Opinion issued in PCT/US2021/013204, dated Apr. 1, 2021, 11 pages.

*Primary Examiner* — Megan Anderson
*Assistant Examiner* — Thao N Do
(74) *Attorney, Agent, or Firm* — Stinson LLP

(57) ABSTRACT

An exercise machine having a force transmission assembly rotatable in first and second directions, first and second wheels rotatable in first and second directions, a first directional coupler that couples the force transmission assembly to the first wheel when the force transmission assembly rotates in the first direction, and a second directional coupler that couples the force transmission assembly to the second wheel when the force transmission assembly rotates in the second direction. The first directional coupler allows the force transmission assembly to rotate with respect to the first wheel when the force transmission assembly moves in the second direction, and the second directional coupler allows the force transmission assembly to rotate with respect to the second wheel when the force transmission assembly moves in the first direction. A resistance mechanism may be configured to resist rotation of the first and second wheels independently from each other.

11 Claims, 10 Drawing Sheets

(52) U.S. Cl.
CPC ..... *A63B 21/157* (2013.01); *A63B 21/4035* (2015.10); *A63B 21/4049* (2015.10)

(58) Field of Classification Search
CPC ..... A63B 21/00061; A63B 21/00065; A63B 21/00069; A63B 21/00072; A63B 21/00076; A63B 21/00178; A63B 21/00171; A63B 21/001785; A63B 21/001789; A63B 21/00192; A63B 21/00196; A63B 21/002; A63B 21/0023; A63B 21/005; A63B 21/0051; A63B 21/0052; A63B 21/02; A63B 21/0125; A63B 21/015; A63B 21/018; A63B 21/021; A63B 21/022; A63B 21/023; A63B 21/025; A63B 21/026; A63B 21/027; A63B 21/028; A63B 21/0189; A63B 21/045; A63B 21/0455; A63B 21/05; A63B 21/04; A63B 21/0442; A63B 21/055; A63B 21/06; A63B 21/0608; A63B 21/0609; A63B 21/0615; A63B 21/0616; A63B 21/0617; A63B 21/0618; A63B 21/062; A63B 21/0622; A63B 21/0624; A63B 21/0626; A63B 21/0628; A63B 21/063; A63B 21/0632; A63B 21/068; A63B 21/08; A63B 21/15; A63B 21/157; A63B 21/159; A63B 21/16; A63B 21/22; A63B 21/222; A63B 21/225; A63B 21/227; A63B 21/40; A63B 21/4001; A63B 21/4011; A63B 21/4013; A63B 21/4015; A63B 21/4017; A63B 21/4019; A63B 21/4021; A63B 21/4023; A63B 21/4025; A63B 21/4027; A63B 21/4033; A63B 21/4034; A63B 21/4035; A63B 21/4039; A63B 21/4041; A63B 21/4043; A63B 21/4045; A63B 21/4047; A63B 21/4049; A63B 22/00; A63B 22/0002; A63B 22/0005; A63B 22/0007; A63B 22/001; A63B 22/0012; A63B 22/0015; A63B 22/0017; A63B 22/0023; A63B 22/0025; A63B 22/0046; A63B 22/0048; A63B 22/0056; A63B 22/0058; A63B 22/0061; A63B 22/0066; A63B 22/0069; A63B 22/0087; A63B 22/0089; A63B 22/04; A63B 22/06; A63B 22/0605; A63B 22/0664; A63B 22/14; A63B 22/16; A63B 22/18; A63B 22/20; A63B 22/201; A63B 22/203; A63B 22/205; A63B 22/208; A63B 2022/0028; A63B 2022/003; A63B 2022/0033; A63B 2022/0035; A63B 2022/0038; A63B 2022/0041; A63B 2022/0043; A63B 2022/0051; A63B 2022/0053; A63B 2022/0071; A63B 2022/0074; A63B 2022/0079; A63B 2022/0082; A63B 2022/0084; A63B 2022/0092; A63B 2022/0271; A63B 2022/0278; A63B 2022/0605; A63B 2022/0611; A63B 2022/0635; A63B 2022/185; A63B 2022/206; A63B 23/00; A63B 23/02; A63B 23/0205; A63B 23/0211; A63B 23/0216; A63B 23/0222; A63B 23/0227; A63B 23/0233; A63B 23/0238; A63B 23/0244; A63B 23/035; A63B 23/03508; A63B 23/03516; A63B 23/03525; A63B 23/03533; A63B 23/03541; A63B 23/0355; A63B 23/03566; A63B 23/03575; A63B 23/03583; A63B 23/03591; A63B 23/04; A63B 23/0405; A63B 23/0417; A63B 23/0423; A63B 23/0429; A63B 23/0476; A63B 23/0482; A63B 23/0488; A63B 23/0494; A63B 23/08; A63B 23/085; A63B 23/10; A63B 23/12; A63B 23/1209; A63B 23/1245; A63B 23/1254; A63B 23/1263; A63B 23/1272; A63B 23/1281; A63B 23/129
USPC ..... 482/92, 34, 146–147, 79–80, 70–71, 482/140–142
See application file for complete search history.

(56) References Cited

U.S. PATENT DOCUMENTS 5,830,107 A * 11/1998 Brigliadoro ..... A63B 23/03575 482/3
5,906,562 A * 5/1999 Lin ..... A63B 23/0211 482/53
5,947,873 A * 9/1999 Sands ..... A63B 22/0056 482/52
6,066,076 A * 5/2000 Wang ..... A63B 22/0061 482/52
6,179,752 B1 * 1/2001 Chang ..... A63B 21/0083 482/52
7,727,121 B1 * 6/2010 Wang ..... A63B 22/0066 482/52
7,833,138 B1 11/2010 Fulks
7,878,957 B1 * 2/2011 Chen ..... A63B 22/0089 D21/676
7,942,798 B2 * 5/2011 Wang ..... A63B 23/0222 482/146
8,052,583 B1 * 11/2011 Tsai ..... A63B 21/4047 482/96
8,277,366 B2 * 10/2012 Savane ..... A63B 22/0056 482/52
9,623,282 B2 * 4/2017 Tung ..... A63B 21/028
10,071,298 B1 * 9/2018 McCormack ..... A63B 69/16
2003/0092546 A1 * 5/2003 Yu ..... A61H 1/0255 482/142
2004/0097336 A1 * 5/2004 Chuang ..... A63B 22/0061 482/52
2004/0097337 A1 * 5/2004 Chuang ..... A63B 22/14 482/52
2007/0142182 A1 * 6/2007 Yang ..... A63B 22/0069 482/52
2007/0179027 A1 * 8/2007 Van Straaten ..... A63B 22/14 482/71
2007/0270294 A1 * 11/2007 Sheets ..... A63B 22/14 482/142
2009/0105051 A1 * 4/2009 Sheets ..... A63B 21/00192 482/148
2010/0179036 A1 * 7/2010 Wang ..... A63B 21/4035 482/112
2010/0210429 A1 * 8/2010 Wang ..... A63B 21/4035 482/127
2011/0160024 A1 6/2011 Candela et al.
2014/0246499 A1 * 9/2014 Proud ..... H04Q 9/00 235/492
2015/0182773 A1 7/2015 Olson et al.
2019/0344118 A1 * 11/2019 Liao Lai ..... A63B 21/023

* cited by examiner

EXERCISE MACHINE WITH BI-DIRECTIONAL ANGULAR RESISTANCE

CROSS-REFERENCE TO RELATED APPLICATIONS

This application is based on and claims priority to U.S. Provisional Application Ser. No. 62/960,813, filed on Jan. 14, 2020, which is incorporated herein by reference in its entirety.

BACKGROUND OF THE INVENTION

1. Field of the Invention

The invention is directed to an exercise machine, and in particular, to an exercise machine with a bi-directional motion system.

2. Description of Related Art

Many different types of exercise machines have been developed for resistance training. Conventional exercise machines are available for exercising all or nearly all of the major muscle groups of the human body. Many types of conventional exercise machines use weights, which are lifted against the force of gravity to exercise desired muscle groups. Other types of exercise machines may use compressed air, friction, or magnets to resist movement by a user.

BRIEF SUMMARY OF THE INVENTION

An exercise machine in accordance with the invention described herein includes a force transmission assembly, at least a portion of which is rotatable in a first direction and a second direction, a first wheel that is rotatable in the first direction, a first directional coupler configured to couple the force transmission assembly to the first wheel when the force transmission assembly rotates in the first direction causing the first wheel to rotate in the first direction, a second wheel rotatable in the second direction, and a second directional coupler configured to couple the force transmission assembly to the second wheel when the force transmission assembly rotates in the second direction causing the second wheel to rotate in the second direction. The first directional coupler is configured to allow the force transmission assembly to rotate with respect to the first wheel when the force transmission assembly rotates in the second direction, and the second directional coupler is configured to allow the force transmission assembly to rotate with respect to the second wheel when the force transmission assembly rotates in the first direction.

The exercise machine may include a resistance mechanism that is configured to resist rotation of the first wheel and the second wheel. The resistance mechanism may include a first magnet positioned adjacent the first wheel and a second magnet positioned adjacent the second wheel. The first magnet may be movable with respect to the first wheel, and the second magnet may be movable with respect to the second wheel. The resistance mechanism may include a first friction surface that is configured to selectively engage the first wheel and a second friction surface that is configured to selectively engage the second wheel. The first friction surface may be movable with respect to the first wheel, and the second friction surface may be movable with respect to the second wheel.

The first directional coupler locks the first wheel to the force transmission assembly when the force transmission assembly moves in the first direction, while the second directional coupler isolates the second wheel from movement of the force transmission assembly in the first direction. Further, the second directional coupler locks the second wheel to the force transmission assembly when the force transmission assembly moves in the second direction, while the first directional coupler isolates the first wheel from movement of the force transmission assembly in the second direction. The resistance mechanism may allow a user to select a desired amount of resistance to movement of the force transmission assembly in the first direction and independently select a desired amount of resistance to movement of the force transmission assembly in the second direction. For example, the user may select a desired amount of resistance to rotation of the first wheel, which corresponds to resistance of movement of the force transmission assembly in the first direction, and the user may independently select a desired amount of resistance to rotation of the second wheel, which corresponds to resistance of movement of the force transmission assembly in the second direction.

The first directional coupler may be a first one way bearing, and the second directional coupler may be a second one way bearing.

The force transmission assembly may include a transmission shaft that is coupled to the first directional coupler and to the second directional coupler. The transmission shaft may be rotatable in the first direction and in the second direction, which is opposite to the first direction. The force transmission assembly may further include a force input device that is coupled to the transmission shaft. The force transmission assembly may further include a pulley system that couples the force input device to the transmission shaft. The exercise machine may further include a platform, and the force input device may include an input shaft that is coupled to the pulley system and a handle that is positioned above the platform. The handle being configured for rotating the input shaft in the first direction and in the second direction.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
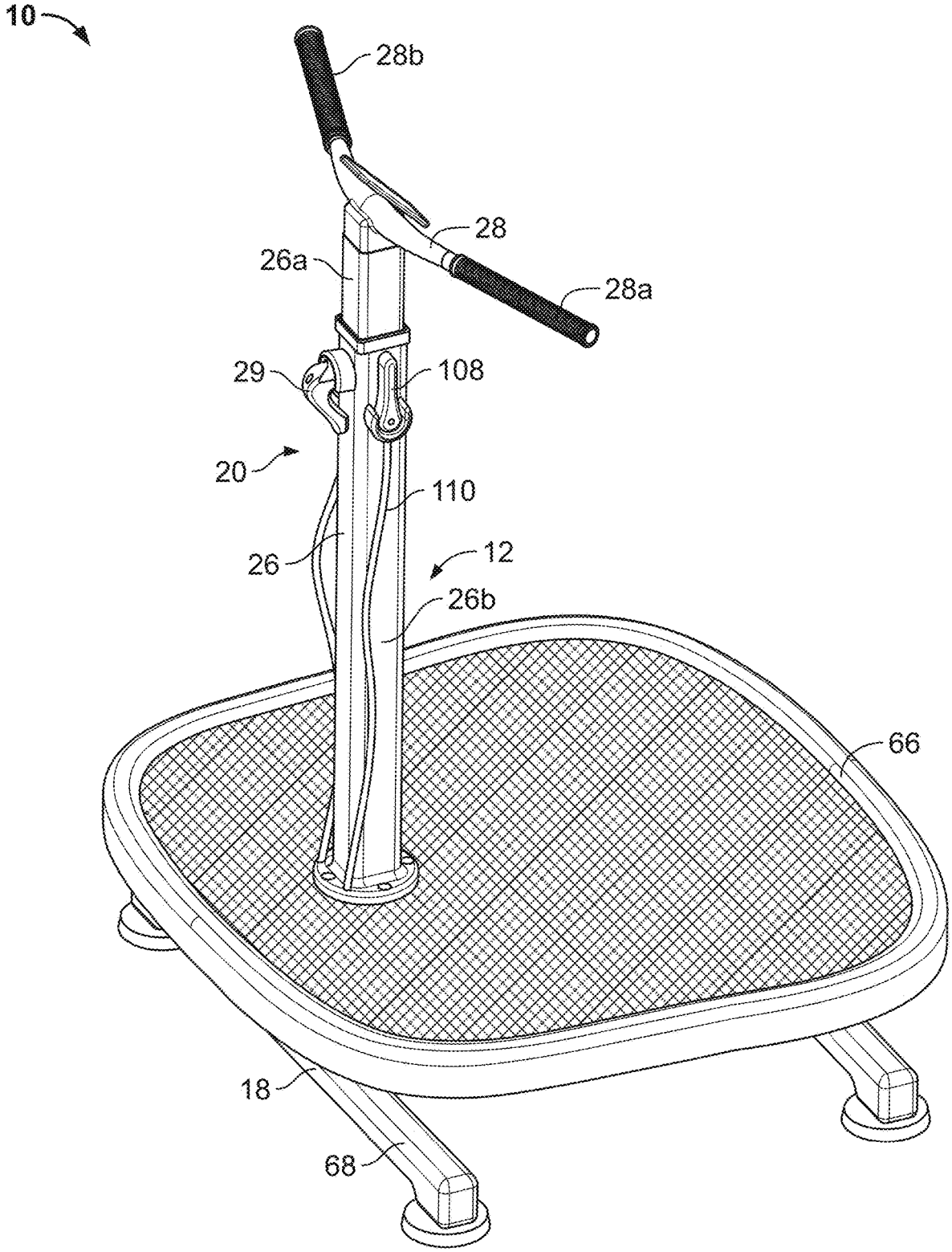
FIG. 1 is a perspective view of an exercise machine in accordance with one exemplary embodiment of the invention described herein.

An exercise machine in accordance with one exemplary embodiment of the invention described herein is identified generally as 10 in FIG. 1. Exercise machine 10 includes a force transmission assembly 12, a bi-directional motion system 14 (FIGS. 4-6), and a resistance mechanism 16 (FIGS. 4-6) each of which being mounted to a base 18. As described in more detail below, bi-directional motion system 14 and resistance mechanism 16 allow a user of exercise machine 10 to select a desired amount of resistance to each direction of the user's rotational movement of force transmission assembly 12. For example, the user may select no or minimal resistance to clockwise rotation of force transmission assembly 12 and a higher level of resistance to counter-clockwise rotation of force transmission assembly 12, or vice-versa.

Figure 6:
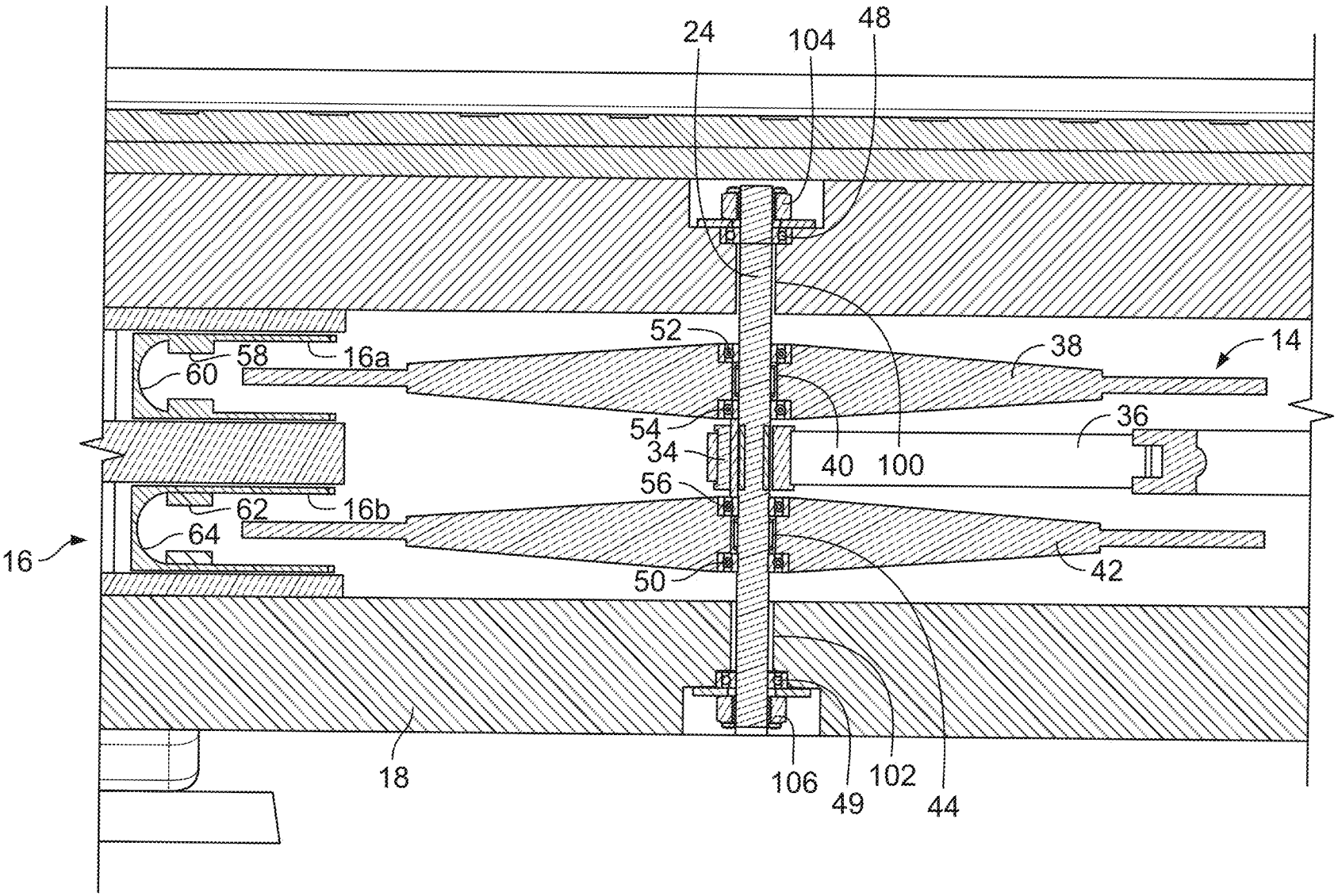
FIG. 6 is a detail view of the bi-directional motion system and resistance mechanism shown in FIG. 5.
Figure 7:
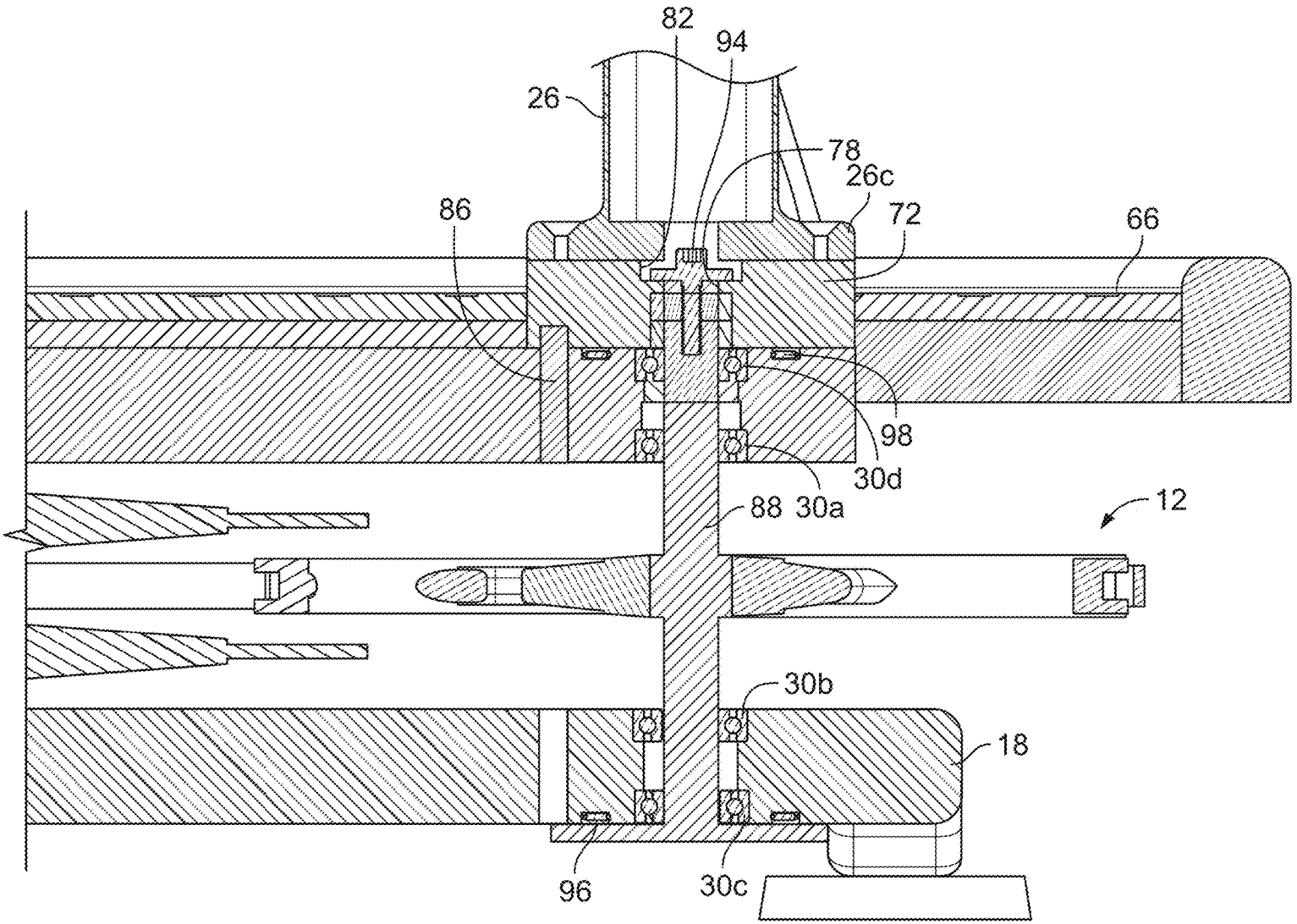
FIG. 7 is a detail view of the force transmission assembly shown in FIG. 5.

Force transmission assembly 12 includes a force input device 20 (FIG. 1), a pulley system 22 (FIG. 4), and a transmission shaft 24 (FIG. 6). The force input device 20 includes a post 26 that extends upward from base 18, as shown in FIG. 1, a handle 28 that is coupled to an upper end of post 26, a motion limiter 72 (FIG. 7), and an input shaft 88 (FIG. 7). The post 26 includes first and second sections 26*a-b* with the first section 26*a* operable to telescope with respect to the second section 26*b*. That is, the first section 26*a* is received within an opening at the top of the second section 26*b* and is movable up and down with respect to the second section 26*b* to adjust a height of the handle 28 above the base 18. The handle 28 is joined to the top of the first section 26*a*. A lever 29 is operable to releasably lock the first and second sections 26*a-b* together. For example, when the lever 29 is in the position shown in FIG. 1, the first section 26*a* may not move relative to the second section 26*b*. When the free end of the lever 29 is rotated outward from the post 26, the first section 26*a* may move up and down with respect to the second section 26*b* to adjust a height of the handle 28 above the base 18.

Figure 8A:
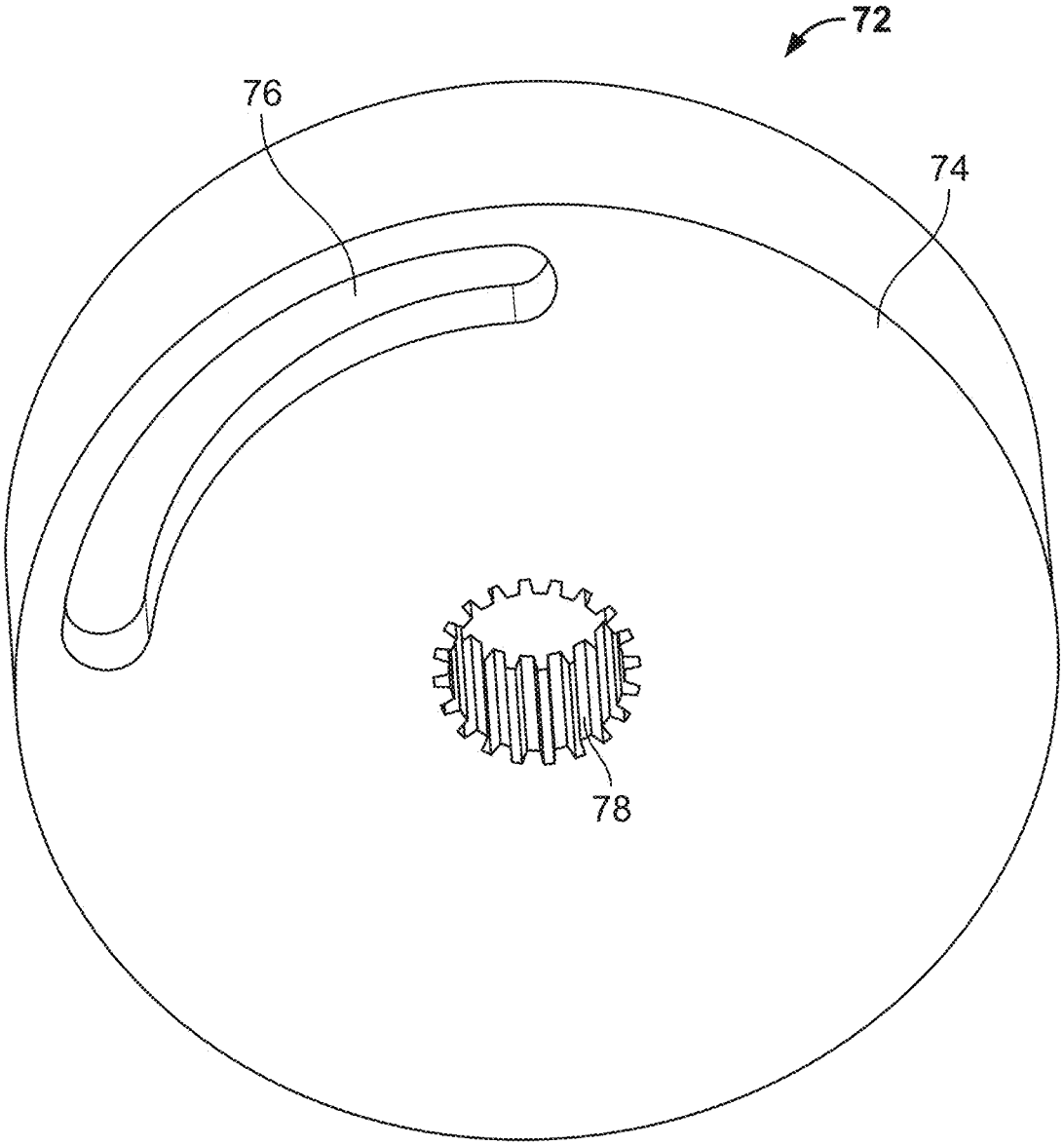
FIGS. 8A and 8B are bottom and top perspective views, respectively, of a motion limiter of the force transmission assembly.
Figure 8B:
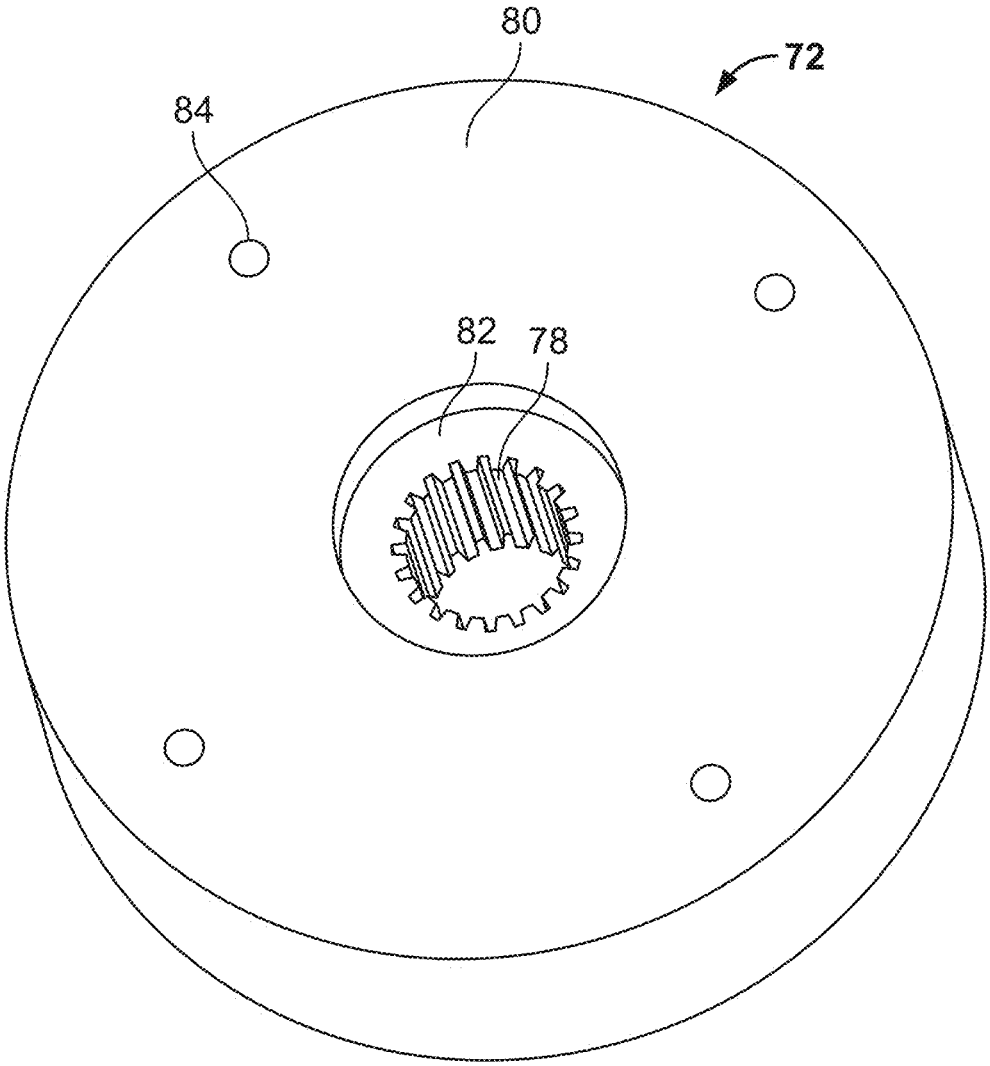

As shown in FIG. 7, the bottom of the second section 26*b* has a flange 26*c* that is joined to a motion limiter 72 with fasteners. The motion limiter 72 rotates with rotation of the handle 28 and post 26. The motion limiter 72, which is shown in more detail in FIGS. 8A and 8B, is cylindrical and has a lower surface 74 with an arcuate slot 76 formed therein adjacent an outer peripheral edge of the motion limiter 72. An opening 78, or splined coupling, extends through the center of the motion limiter 72. An upper surface 80 of the motion limiter 72 includes a circular recess 82 surrounding the opening 78, and a plurality of openings 84 for receiving fasteners to mount the motion limiter 72 to the post 26.

As shown in FIG. 7, a pin 86 extending upward from a portion of the base 18 is received within the slot 76 of the motion limiter 72. As the handle 28, post 26, and motion limiter 72 are rotated back and forth, the pin 86 moves through the slot 76. When the pin 86 reaches either end of the slot 76, further rotation of the handle 28, post 26, and motion limiter 72 is prevented.

Figure 9:
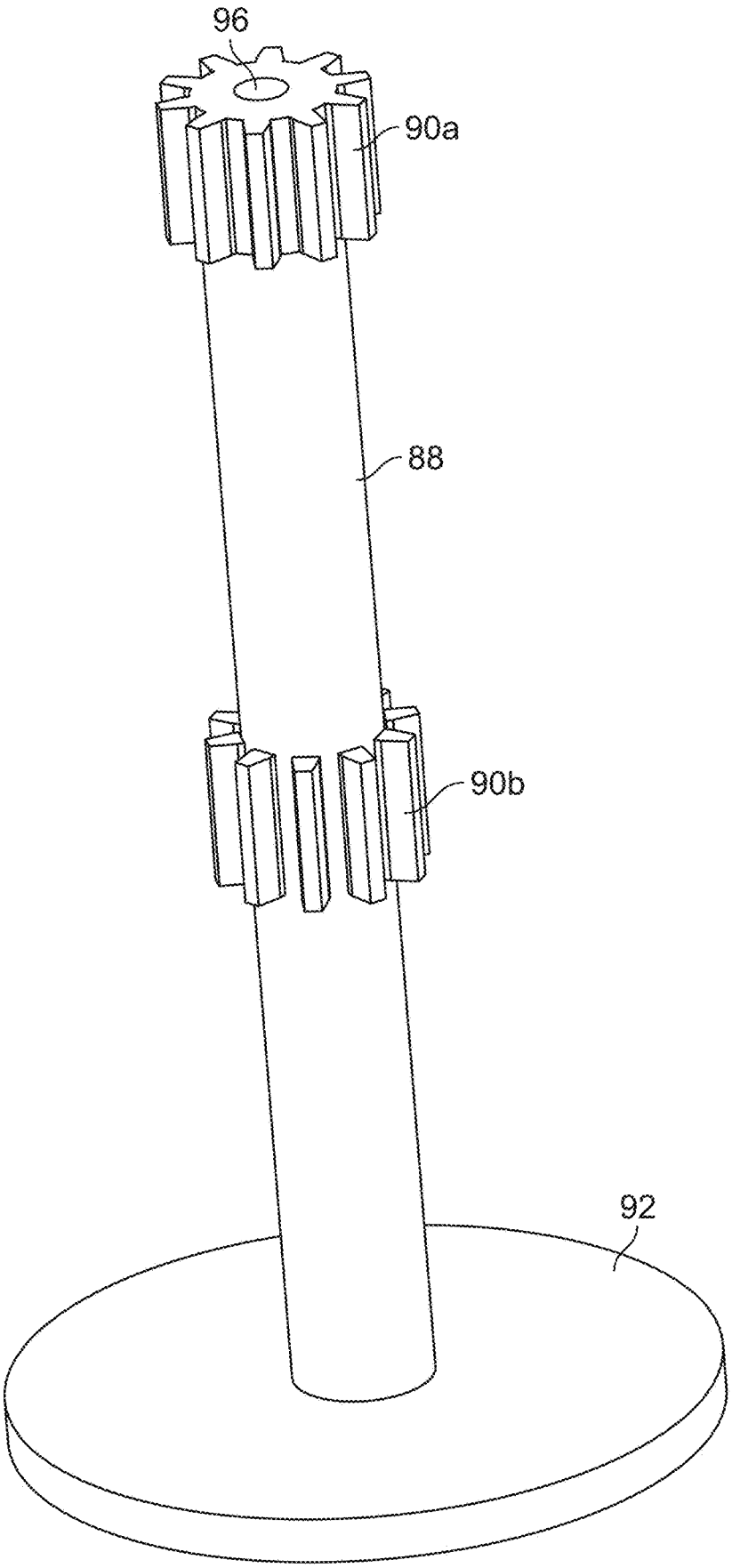
FIG. 9 is a perspective view of an input shaft of the force transmission assembly.

The input shaft 88 joins to the motion limiter 72 and the pulley system 22 so that rotation of the handle 28 also rotates the pulley system 22 in the same direction that the handle 28 is rotated. Referring to FIG. 9, the input shaft 88 includes first and second splined surfaces 90*a-b* and a lower flange 92. The first splined surface 90*a* is received within the opening 78 of the motion limiter 72 so that rotation of the motion limiter 72 also rotates the input shaft 88. Further, a fastener 94, shown in FIG. 7, extends through the opening 78 and engages a threaded opening 96 in the input shaft 88 to securely mount the input shaft 88 to the base 18 and the motion limiter 72. The fastener 94 is positioned within the recess 82 of the motion limiter 72 and includes a flange that engages a lower surface of the recess 82 adjacent the opening 78. A roller bearing 96 is positioned between an upper surface of the lower flange 92 of the input shaft 88 and a lower surface of the base 18 allowing the input shaft 88 to freely rotate with respect to the base 18. Another roller bearing 98 is positioned between a lower surface of the motion limiter 72 and an upper surface of the base 18 allowing the motion limiter 72 and input shaft 88 to freely rotate with respect to the base 18. Tightening the fastener 94 axially clamps the motion limiter 72 and input shaft 88 to the base 18 while the roller bearings 96 and 98 still allow rotational movement of the motion limiter 72 and input shaft 88 relative to the base 18. The input shaft 88 is further mounted to base 18 via bearings 30*a-d*, shown in FIG. 7, that allow input shaft 88 to freely rotate with respect to base 18.

Figure 4:
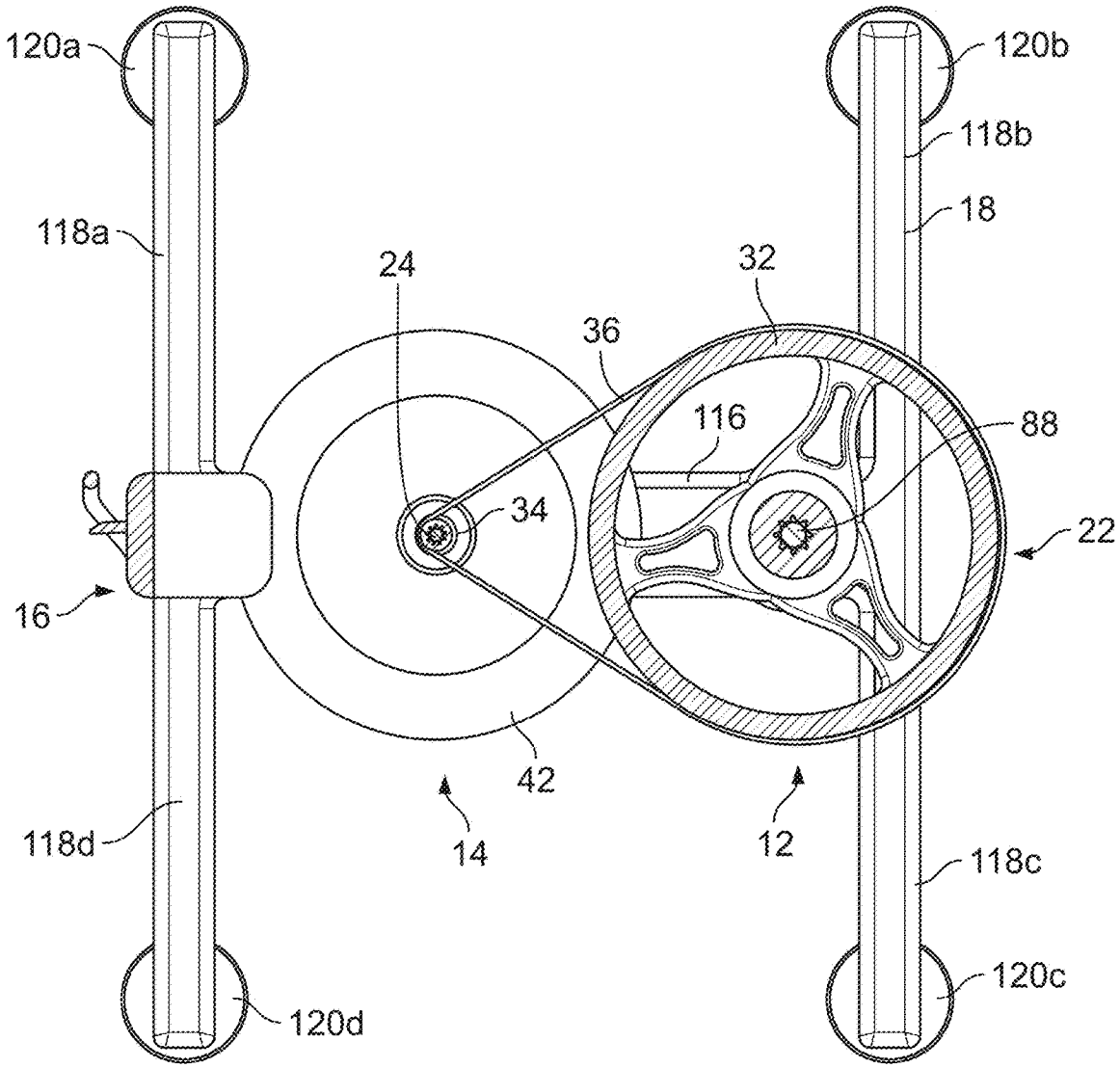
FIG. 4 is a cross-sectional view taken through the line 4-4 of FIG. 2 and showing a force transmission assembly, a bi-directional motion system, and a resistance mechanism of the exercise machine shown in FIG. 1.

As shown in FIG. 1, handle 28 extends laterally outward from each side of post 26 in a manner such that handle 28 is configured for grasping by a user to rotate post 26, motion limiter 72 and input shaft 88. For example, a user standing on base 18 may grasp one side 28*a* of handle 28 with one hand and the opposite side 28*b* of handle 28 with the other hand. The user may use his or her hands to rotate post 26 by, for example, pulling one hand closer to his or her torso while pushing the other hand farther away from his or her torso. The handle 28 is configured so that it may rotate the post 26 and input shaft 88 in a first direction, e.g., a clockwise direction when viewed as shown in FIG. 4, and a second direction, e.g., a counter-clockwise direction when viewed as shown in FIG. 4. The post 26 may be configured so that it may be disconnected from base 18 for storage and/or shipping of exercise machine 10 and then reconnected when it is desired to use the machine.

Figure 5:
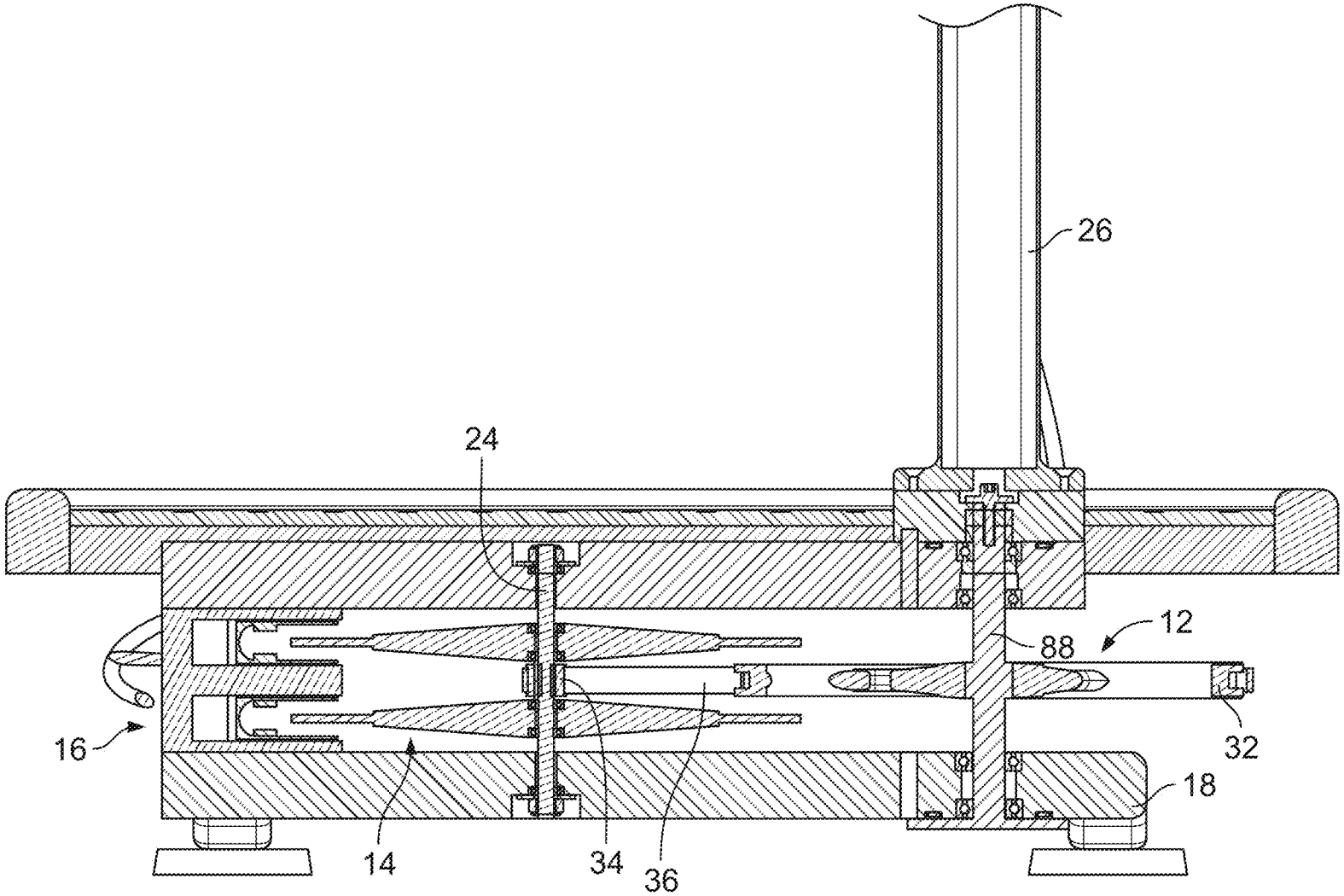
FIG. 5 is a cross-sectional view taken through the line 5-5 of FIG. 3.

As shown in FIGS. 4 and 5, the pulley system 22 includes a first pulley 32 that is mounted on input shaft 88, a second pulley 34 that is mounted on transmission shaft 24, and a belt 36 linking the two pulleys 32, 34 such that they rotate together. As shown, second pulley 34 has a smaller diameter than first pulley 32 so that rotation of first pulley 32 via input shaft 88 and handle 28 rotates second pulley 34 at a higher speed with lower torque. The relative diameters of second pulley 34 and first pulley 32 may be chosen based on resistance mechanism 16 and desired amounts of resistance to a user rotating force input device 20. As shown in FIG. 6, second pulley 34 is mounted to a middle of transmission shaft 24 in a manner such that rotation of second pulley 34 also rotates transmission shaft 24. The second pulley 34 may have a splined opening that receives a splined surface of the transmission shaft 24. Transmission shaft 24 is rotatable by second pulley 34 in a first direction, e.g., a clockwise direction when viewed as shown in FIG. 4, and a second direction, e.g., a counter-clockwise direction when viewed as shown in FIG. 4.

Referring to FIG. 6, bi-directional motion system 14 includes a first wheel 38, a first directional coupler 40, a second wheel 42 and a second directional coupler 44. First wheel 38, first directional coupler 40, second wheel 42, and second directional coupler 44 are mounted to base 18 via transmission shaft 24. Transmission shaft 24 extends through openings 100 and 102 in base 18. A nut 104 threaded on an upper end of the transmission shaft 24, and a nut 106 threaded on a lower end of the transmission shaft 24 engage the base 18 to secure the transmission shaft 24 to the base 18. Bearings 48 and 49 are positioned between the transmission shaft 24 and the base 18 to allow the transmission shaft 24 to rotate with respect to the base 18.

First wheel 38 is mounted to transmission shaft 24 with a pair of roller bearings 52 and 54 and the first directional coupler 40, which is positioned between the roller bearings 52 and 54. The transmission shaft 24 passes through a central opening of first wheel 38. The roller bearings 52, 54 and first directional coupler 40 are positioned within the central opening between an interior surface of the first wheel 38 and an outer surface of the transmission shaft 24. The roller bearings 52 and 54 allow free rotation of first wheel 38 with respect to transmission shaft 24, while the first directional coupler 40 locks first wheel 38 to transmission shaft 24 in one direction but allows free rotation of first wheel 38 with respect to transmission shaft 24 in the opposite direction of rotation. For example, when the transmission shaft 24 rotates in the clockwise direction, when viewed as shown in FIG. 4, the first directional coupler 40 may lock the first wheel 38 to the transmission shaft 24 such that the first wheel 38 also rotates in the clockwise direction (i.e., the first directional coupler 40 transfers torque from the transmission shaft 24 to the first wheel 38). When the transmission shaft 24 rotates in the counter-clockwise direction, when viewed as shown in FIG. 4, the first directional coupler 40 may allow transmission shaft 24 to rotate freely with respect to the first wheel 38 such that the first wheel 38 does not rotate with rotation of transmission shaft 24 (i.e., the first directional coupler 40 does not transfer torque from the transmission shaft 24 to the first wheel 38). The first directional coupler 40 may also be oriented in the reverse orientation such that the first wheel 38 does not rotate with clockwise rotation of transmission shaft 24 and the first wheel does rotate with counter-clockwise rotation of transmission shaft 24. As such, the first wheel 38 may rotate in the clockwise or counter-clockwise directions. The first directional coupler 40 may be a one way bearing or a directional pin needle bearing.

Second wheel 42 is mounted to transmission shaft 24 with a pair of roller bearings 50 and 56 and the second directional coupler 44, which is positioned between the roller bearings 50 and 56. The transmission shaft 24 passes into a central opening of second wheel 42. The roller bearings 50 and 56 and second directional coupler 44 are positioned within the central opening between an interior surface of the second wheel 42 and an outer surface of the transmission shaft 24. The roller bearings 50 and 56 allow free rotation of second wheel 42 with respect to transmission shaft 24, while the second directional coupler 44 locks second wheel 42 to transmission shaft 24 in one direction but allows free rotation of second wheel 42 with respect to transmission shaft 24 in the opposite direction of rotation. For example, when the transmission shaft 24 rotates in the counter-clockwise direction, when viewed as shown in FIG. 4, the second directional coupler 44 may lock the second wheel 42 to the transmission shaft 24 such that the second wheel 42 also rotates in the counter-clockwise direction (i.e., the second directional coupler 44 transfers torque from the transmission shaft 24 to the second wheel 42). When the transmission shaft 24 rotates in the clockwise direction, when viewed as shown in FIG. 4, the second directional coupler 44 may allow transmission shaft 24 to rotate freely with respect to the second wheel 42 such that the second wheel 42 does not rotate with rotation of transmission shaft 24 (i.e., the second directional coupler 44 does not transfer torque from the transmission shaft 24 to the second wheel 42). The second directional coupler 44 may also be oriented in the reverse orientation such that the second wheel 42 does not rotate with counter-clockwise rotation of transmission shaft 24 and the second wheel 42 does rotate with clockwise rotation of transmission shaft 24. As such, the second wheel 42 may rotate in the clockwise or counter-clockwise directions. The second directional coupler 44 may be a one way bearing or a directional pin needle bearing.

The first directional coupler 40 and the second directional coupler 44 may be oriented so that one of the first wheel 38 and the second wheel 42 rotates when handle 28 (FIG. 1) is rotated in one direction while the other of first wheel 38 and second wheel 42 remains stationary, and so that when handle 28 is rotated in the opposite direction, the previously moving one of the first wheel 38 and second wheel 42 becomes stationary and the previously stationary one of the first wheel 38 and second wheel 42 moves with rotation of the handle 28.

As shown in FIG. 6, the resistance mechanism 16 includes a first section 16*a* positioned adjacent the first wheel 38 and a second section 16*b* positioned adjacent the second wheel 42. The first section 16*a* is configured to resist rotation of the first wheel 38, and the second section 16*b* is configured to resist rotation of the second wheel 42. The first and second sections 16*a-b* may be included together in an integral housing structure. The first section 16*a* may include a first magnet 58 that is oriented so that a magnetic field generated by the first magnet 58 resists rotation of the first wheel 38 in the direction that first directional coupler 40 transfers torque from transmission shaft 24 to first wheel 38 (e.g., the clockwise direction when viewed as shown in FIG. 4). The first wheel 38 may be formed from a ferromagnetic material such that the magnetic field generated by the first magnet 58 resists rotation of the first wheel 38. The first magnet 58 may also be an electromagnet that is configured to generate a magnetic field for resisting rotation of the first wheel 38. The first magnet 58 may include a plurality of magnets positioned both above and below the first wheel 38.

The first magnet 58 may be adjustable by a user for altering the effect of the magnetic field generated by the first magnet 58 on the first wheel 38. For example, the first magnet 58 may be movable toward and away from the first wheel 38 for altering the magnitude of the resistance on the first wheel 38 from the magnetic field. In such a configuration, the first magnet 58 may be mounted on a movable structure (not shown) that is movable by a user to move the first magnet 58 toward the first wheel 38 for increasing the resistance on the first wheel 38 and away from the first wheel 38 for decreasing the resistance on the first wheel 38. For example, the lever 108 shown in FIG. 1 may be rotated toward or away from a user standing on the platform 66 to move the first magnet 58 either toward or away from the first wheel 38. The lever 108 is connected to a cable 110 that is routed to the first magnet 58. Rotation of the lever 108 toward the user may move the cable 110 so that the cable 110 causes movement of the first magnet 58 toward the first wheel 38 to increase resistance. Rotation of the lever 108 away from the user may move the cable 110 so that the cable 110 causes movement of the first magnet 58 away from the first wheel 38 to decrease resistance. If the first magnet 58 is an electromagnet, the magnitude of the magnetic field generated by the electromagnet may be user adjustable with, for example, a control knob or user input device, such as lever 108, that alters the amount of power delivered to the electromagnet during operation. For example, more power or current delivered to the electromagnet may increase the magnitude of the magnetic field and increase the resistance on first wheel 38 and less power or current delivered to the electromagnet may decrease the magnitude of the magnetic field and decrease the resistance on first wheel 38.

As an alternative to the first section 16*a* of resistance mechanism 16 including a first magnet 58, or in addition to the first section 16*a* including a first magnet 58, the first section 16*a* may include a first friction surface 60 that is configured to selectively engage the first wheel 38 for resisting rotation of the first wheel 38. The first friction surface 60 may be adjustable by a user for altering the effect of the first friction surface 60 on the first wheel 38. For example, the first friction surface 60 may be movable toward and away from the first wheel 38 for altering the amount of force with which the first friction surface 60 engages the first wheel 38, and thereby altering the magnitude of the resistance on the first wheel 38 from the first friction surface 60. In such a configuration, the first friction surface 60 may be mounted on a movable structure (not shown) that is movable by a user to move the first friction surface 60 toward the first wheel 38 for increasing the resistance on the first wheel 38 and away from the first wheel 38 for decreasing the resistance on the first wheel 38.

The second section 16*b* of the resistance mechanism 16 may be configured and operate in a substantially similar manner as described above with respect to the first section 16*a* of the resistance mechanism 16. For example, the second section 16*b* may include a second magnet 62 that is configured and operates in a substantially similar manner as the first magnet 58 described above. The second magnet 62 may include a plurality of magnets positioned both above and below the second wheel 42. The lever 112 shown in FIG. 2 may be rotated toward or away from a user standing on the platform 66 to move the second magnet 62 either toward or away from the second wheel 42. The lever 112 is connected to a cable 114 that is routed to the second magnet 62. Rotation of the lever 112 toward the user may move the cable 114 so that the cable 114 causes movement of the second magnet 62 toward the second wheel 42 to increase resistance. Rotation of the lever 112 away from the user may move the cable 114 so that the cable 114 causes movement of the second magnet 62 away from the second wheel 42 to decrease resistance. Further, as an alternative to including a second magnet 62, or in addition to including a second magnet 62, the second section 16*b* may include a second friction surface 64 that is configured and operates in a substantially similar manner as the first friction surface 60 described above. The second section 16*b* of resistance mechanism 16 may be adjustable independent from the first section 16*a* with levers 108 and 112 such that there are different levels of resistance to rotation of first and second wheels 38 and 42.

Figure 2:
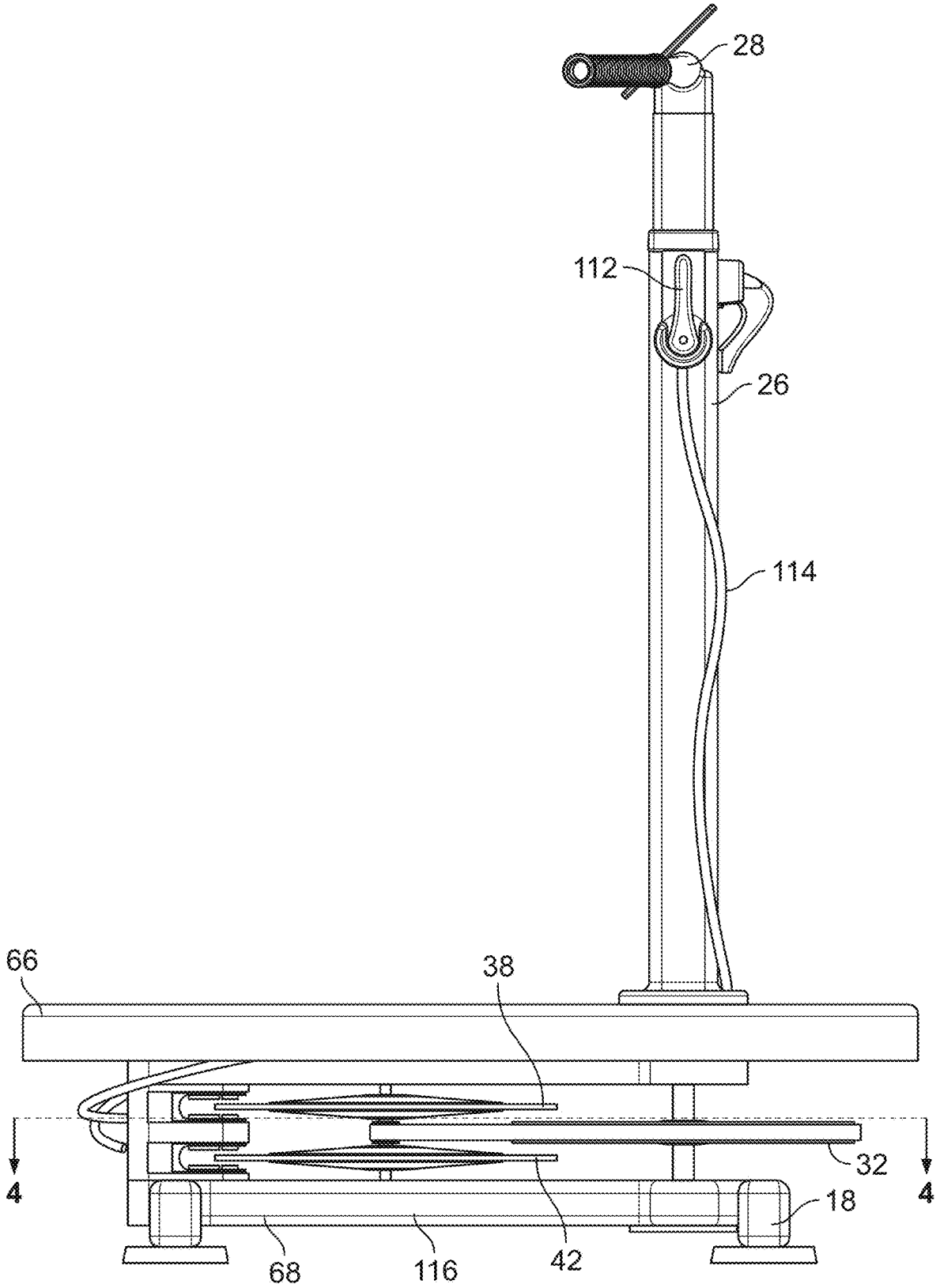
FIG. 2 is a side elevational view of the exercise machine shown in FIG. 1.
Figure 3:
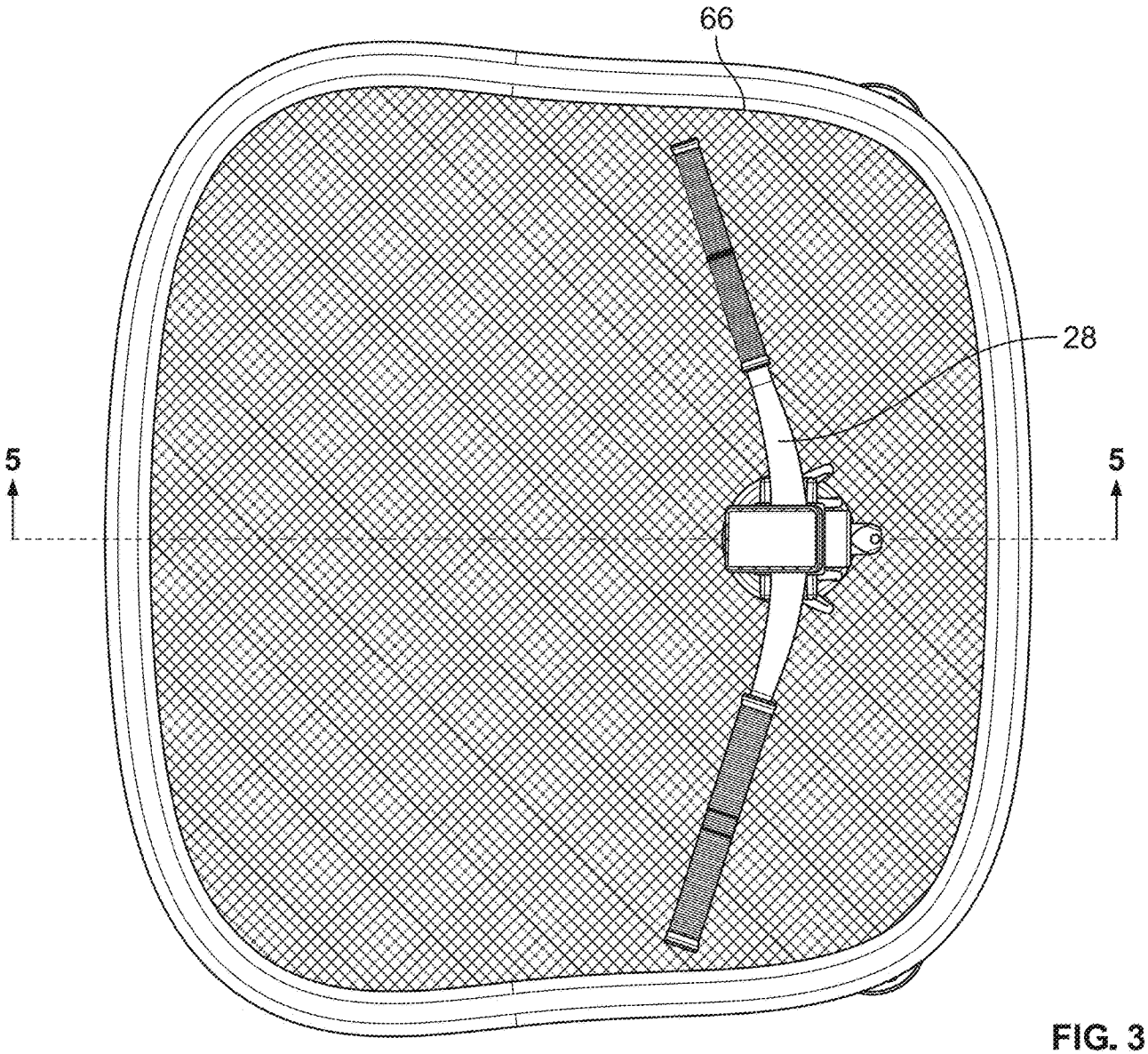
FIG. 3 is a top plan view of the exercise machine shown in FIG. 1.

As shown in FIGS. 1 and 2, base 18 has an upper platform 66 and a lower platform 68 that are spaced apart by the resistance mechanism 16. The force transmission assembly 12, bi-directional motion system 14, and resistance mechanism 16 are mounted to the base 18. The bi-directional motion system 14 and resistance mechanism 16 may be mounted to base 18 and positioned between the upper platform 66 and lower platform 68. The pulley system 22 and transmission shaft 24 of force transmission assembly 12 may be mounted to base 18 and positioned between the upper platform 66 and lower platform 68, while the force input device 20 may be mounted to base 18 and, at least partially, positioned above the upper platform 66. The upper platform 66 provides a surface upon which a user may stand and grasp the force input device 20 for exercising with the exercise machine 10. The motion limiter 72 of force input device 20 extends through an opening in the upper platform 66, as shown in FIG. 7, in a manner that allows the motion limiter 72 to rotate with respect to the upper platform 66. The lower platform 68 includes a central bar 116 that is positioned underneath the second wheel 42 and pulley 32, as shown in FIG. 2. The lower platform 68 further includes legs 118*a-d* that extend laterally outward from the central bar 116 as shown in FIG. 4. Feet 120*a-d* are mounted to outward ends of the legs 118*a-d* to support the exercise machine 10 on a surface.

To use exercise machine 10, a user first selects the amount of resistance desired for both the first wheel 38 and the second wheel 42, for example, by using the levers 108 and 112. The resistance on first wheel 38 may correspond to resistance of rotation of handle 28 in a clockwise direction, when viewed as shown in FIG. 4, and the resistance on second wheel 42 may correspond to resistance of rotation of handle 28 in a counter-clockwise direction, also when viewed as shown in FIG. 4. As described above, to alter the resistance on first wheel 38, the user may move the first magnet 58 of resistance mechanism 16 toward or away from the first wheel 38 using lever 108 and/or the user may use a control knob or user input device (not shown) to alter the amount of power delivered to an electromagnet of the resistance mechanism 16. The user may likewise alter the resistance on second wheel 42 in a substantially similar manner as used to alter the resistance of first wheel 38.

Once desired levels of resistance are selected, the user stands on upper platform 66 and grasps the handle 28 with one hand on side 28*a* and the other hand on side 28*b* of the handle 28. The user may stand on upper platform 66 facing post 26. The user may then rotate handle 28, post 26, motion limiter 72, and input shaft 88 by pushing with one hand while pulling with the opposite hand. As the user completes this motion, the user's torso and hips may slightly rotate in the same direction as the handle 28. As the user rotates the handle 28, the pulley system 22 rotates the transmission shaft 24, which thereby causes rotation of either the first wheel 38 or the second wheel 42 (e.g., the first wheel 38 may be rotated if the handle 28 is rotated in a clockwise direction, and the second wheel 42 may be rotated if the handle 28 is rotated in a counter-clockwise direction). The resistance mechanism 16 resists rotation of the first wheel 38 or second wheel 42, in the manner described above, and thus resists rotation of the handle 28 by the user. After the user has rotated handle 28 a desired amount (e.g., when the motion limiter 72 prevents further rotation of the handle), the user may rotate the handle 28 in the other direction by pulling the handle 28 toward his or her body with the hand that was previously extended and pushing the handle 28 away from his or her body with the hand that was previously retracted. As handle 28 rotates in this opposite direction, the resistance mechanism 16 may resist rotation of handle 28 by resisting rotation of the other of the first wheel 38 and second wheel 42, i.e., the wheel not resisted when handle 28 was initially rotated. The user may alternate rotating the handle 28 in a clockwise and then counter-clockwise direction in this manner a desired number of times.

In accordance with one method of exercising with exercise machine 10, the user may alter the resistance on first wheel 38 so that there is a substantial amount of resistance to rotation of handle 28 in the clockwise direction. The user may further alter the resistance on second wheel 42 so that there is no or a minimal amount of resistance to rotation of handle 28 in the counter-clockwise direction. By using the exercise machine 10 in this manner, it isolates certain muscle groups of the user's body since there is only resistance when the handle 28 is rotated in the clockwise direction. The user may further use the machine with little to no resistance on first wheel 38 and a substantial amount of resistance on second wheel 42 such that there is only resistance to counter-clockwise rotation of handle 28. The user may further alter body positioning and foot stance on base 18 so that certain desired muscles are used to rotate handle 28.

Although exercise machine 10 is shown in FIG. 1 having a force input device 20 with a rotatable handle 28 positioned above base 18, other configurations of force input device 20 may be used with exercise machine 10. For example, the force input device 20 may include a bar or platform that is configured to be pressed or pulled, a cable or cables that are configured to be pulled, or a handle that is configured to be rotated about an axis that is substantially parallel to base 18 or other than substantially perpendicular to base 18. Such bar, platform, cable(s), or handle may be mechanically linked to transmission shaft 24 in any suitable manner for rotation of transmission shaft 24 and first and second wheels 38, 42 in the manner described above. Base 18 may further be reconfigured to include a bench, seat, or other desired structure that is configured for operation with the force input device 20 and to assist the user in performing a desired range of motion. The exercise machine 10 may also be configurable for use with one or more force input devices 20, including those described above. Further, the resistance mechanism 16 may be any type of suitable resistance mechanism, in addition to those described above, that is configured to resist rotation of the first wheel 38 and the second wheel 42.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. An exercise machine comprising:

a force transmission assembly at least a portion of which is rotatable in a first direction and a second direction that is different than the first direction;

a first wheel rotatable in the first direction;

a first directional coupler configured to couple the force transmission assembly to the first wheel when the force transmission assembly rotates in the first direction causing the first wheel to rotate in the first direction, wherein the first directional coupler is configured to allow the force transmission assembly to rotate with respect to the first wheel when the force transmission assembly rotates in the second direction;

a second wheel rotatable in the second direction; and a second directional coupler configured to couple the force transmission assembly to the second wheel when the force transmission assembly rotates in the second direction causing the second wheel to rotate in the second direction, wherein the second directional coupler is configured to allow the force transmission assembly to rotate with respect to the second wheel when the force transmission assembly rotates in the first direction.

2. The exercise machine of claim 1, further comprising a resistance mechanism that is configured to resist rotation of the first wheel and the second wheel.

3. The exercise machine of claim 2, wherein the resistance mechanism comprises a first magnet positioned adjacent the first wheel and a second magnet positioned adjacent the second wheel.

4. The exercise machine of claim 3, wherein the first magnet is movable with respect to the first wheel, and wherein the second magnet is movable with respect to the second wheel.

5. The exercise machine of claim 2, wherein the resistance mechanism comprises a first friction surface that is configured to selectively engage the first wheel and a second friction surface that is configured to selectively engage the second wheel.

6. The exercise machine of claim 5, wherein the first friction surface is movable with respect to the first wheel, and wherein the second friction surface is movable with respect to the second wheel.

7. The exercise machine of claim 1, wherein the force transmission assembly comprises a transmission shaft that is coupled to the first directional coupler and to the second directional coupler, and wherein the transmission shaft is rotatable in the first direction and in the second direction, which is opposite to the first direction.

8. The exercise machine of claim 7, wherein the force transmission assembly further comprises a force input device that is coupled to the transmission shaft.

9. The exercise machine of claim 8, wherein the force transmission assembly further comprises a pulley system that couples the force input device to the transmission shaft.

10. The exercise machine of claim 9, further comprising a platform, and wherein the force input device comprises an input shaft that is coupled to the pulley system and a handle that is positioned above the platform, wherein the handle is configured for rotating the input shaft in the first direction and in the second direction.

11. The exercise machine of claim 1, wherein the first directional coupler comprises a first one way bearing, and wherein the second directional coupler comprises a second one way bearing.

* * * * *